United States Patent [19]

Shoji et al.

[11] Patent Number: 4,727,524

[45] Date of Patent: Feb. 23, 1988

[54] WATCH WITH INTEGRAL BAND AND CASE

[75] Inventors: Masaru Shoji, Saitama; Toshiyuki Sekine, Tokyo, both of Japan

[73] Assignee: Casio Computer Co., Ltd., Tokyo, Japan

[21] Appl. No.: 80,161

[22] Filed: Feb. 27, 1987

Related U.S. Application Data

[63] Continuation of Ser. No. 714,189, Mar. 20, 1985.

[51] Int. Cl.[4] ..... G04B 37/00

[52] U.S. Cl. ..... 368/281; 368/276; 368/88

[58] Field of Search ..... 368/281, 282, 276, 88, 368/300

[56] References Cited

U.S. PATENT DOCUMENTS

| | | | |
|---|---|---|---|
| 3,675,414 | 7/1972 | Cachelin | 368/282 |
| 3,977,176 | 8/1976 | Murakami et al. | 368/280 |
| 4,178,751 | 12/1979 | Liautaud | 368/282 |
| 4,186,552 | 2/1980 | Ishigaki et al. | 368/281 |
| 4,229,936 | 10/1980 | Schneider et al. . | |
| 4,261,049 | 4/1981 | Komiyama et al. . | |
| 4,462,697 | 7/1984 | Thompson | 368/282 |

FOREIGN PATENT DOCUMENTS

| | | |
|---|---|---|
| 0098239 | 1/1984 | European Pat. Off. . |
| 2753447 | 6/1978 | Fed. Rep. of Germany . |
| 2382716 | 9/1978 | France . |
| 2457516 | 12/1980 | France . |
| 196015 | 2/1938 | Switzerland . |
| 620081 | 11/1980 | Switzerland . |
| 1189909 | 4/1970 | United Kingdom . |
| 2115954A | 9/1983 | United Kingdom . |

OTHER PUBLICATIONS

Search Report/French Patent Office.
Office Action/Search Report/German Patent Office.
Precision H 11/1982, pp. 43, 45. German Office Action.
English Translation of Office Action.

*Primary Examiner*—Bernard Roskoski
*Attorney, Agent, or Firm*—Frishauf, Holtz, Goodman & Woodward

[57] ABSTRACT

In a case structure for use in a wrist watch, watch parts for displaying the time for the watch user are received in a receptacle, and a band is formed integral to the receptacle to attach said receptacle to an arm of the watch user. The receptacle is made of a rigid plastic material, while the band is made of a flexible plastic material. The watch parts are attached directly to the receptacle.

15 Claims, 14 Drawing Figures

WATCH WITH INTEGRAL BAND AND CASE

This application is a continuation of application Ser. No 714,189 filed Mar. 20, 1985.

BACKGROUND OF THE INVENTION

The present invention relates to a watch and, more particularly, a case for use to the digital wrist watch.

Cheap digital wrist watches have been marketed and become more popular these days. Each of these digital wrist watches has a piece of transparent glass attached to the top of a case, a module housed in the case, and a back lid attached to the bottom side of the case. A band is further attached in a outer wall of the case by means of rods each of which has spring-engaged portions at both ends thereof. The module includes an integrated circuit chip, a source of timing signals or a pulse generator, a display (typically light emitting diodes or a liquid crystal material), and one or more batteries.

In the case of these digital wrist watches, the band is made independently of the case and band-attaching portions must be therefore formed at the outer wall of the case. For the purpose of eliminating this drawback, U.S. Pat. No. 4,229,936, issued Aug. 28, 1980, discloses a case formed integral to the band. The digital wrist watch proposed by this U.S. patent enables the band to be made integral to the case, making it unnecessary to use the rods for attaching the band to the case, and the assembly of the digital wrist watch to be thus made easier because the number of parts used for the watch can be reduced. In the case of this U.S. patent, however, the structure of the case and band is made of soft resin, thereby causing a problem in the structural strength of the watch. More specifically, an auxiliary member or housing, that is, a front case is needed in the case of this U.S. patent to sufficiently protect the module and house the other parts. Therefore, the digital wrist watch cannot be made slim and small in size because of the auxiliary member or housing used.

SUMMARY OF THE INVENTION

The present invention is therefore intended to eliminate the above-mentioned drawbacks.

An object of the present invention is to provide a case structure for use in a wrist watch, having a band made integral to a case, without using any auxiliary member, simple and strong in structure, and enabling any parts to be easily attached thereto.

Another object of the present invention is to provide a wrist watch which is made slim and small in size, using the case structure.

According to the present invention, the case structure comprises a receptacle for receiving parts to display the time for the watch user and a band formed integral to the receptacle to attach the receptacle to an arm of the watch user. The receptacle is made of rigid plastic material while the band is made of flexible plastic material which is softer than the rigid plastic material.

When arranged as described above, the band can be made integral to the case, without using any auxiliary member, to thereby provide a strong case structure. In addition, the parts used can be attached directly to the receptacle. The watch can be thus made simpler in structure and assembled more easily.

DETAILED DESCRIPTION OF THE PREFERRED EMBODIMENT

Figure 1:
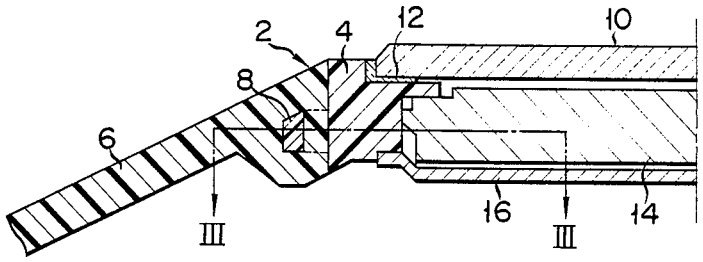
FIG. 1 is an enlarged sectional view showing a digital wrist watch to which a first example of the case structure according to the present invention is applied.
Figure 2:
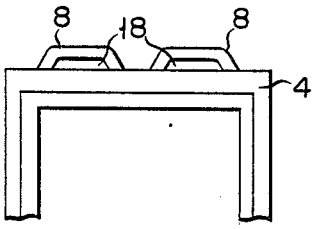
FIG. 2 is an enlarged plan view showing projections projected from the case section of the wrist watch shown in FIG. 1.
Figure 3:
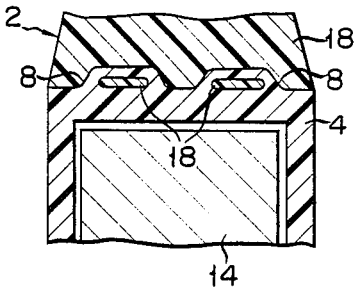
FIG. 3 is a schematic sectional view taken along the line III—III in FIG. 1.

Referring to FIGS. 1 through 3, an embodiment of the present invention will be described.

FIG. 1 is a sectional view showing a digital wrist watch to which a case structure of the present invention is applied. The digital wrist watch has a structure 2 comprising a composite band and case. More specifically, the structure 2 comprises a case section 4 and a band section 6 molded integral to the case section 4 according to a manner which will be described later. The case section 4 is provided with a protrusive portion 8, which is projected into the band section 6. The case section 4 is made of rigid resin such as ABS (acrylonitrile-butadiene-styrene), for example, while the band section 6 of flexible resin such as polyurethane, for example, which is softer than the rigid resin of the case section 4.

A transparent glass panel 10 is pressed into the top of the case section 4 through a glass packing 12. A module 14 is housed in the case section 4. The module 14 includes a source of timing signals, a crystal display means, an LSI, batteries and the like. A back lid 16 is pressed into the back side of the case section 4.

A manner for molding the structure 2 which comprises the case and band sections 4 and 6 will be described referring to FIGS. 2 and 3.

FIG. 2 shows the protrusive portion 8 projected from the case section 4. As shown in FIG. 2, the protrusive portion 8 projected from the case section 4 is provided with spaces 18. FIG. 3 is a sectional view taken along the line III—III in FIG. 1 and showing the structure 2 molded.

The case section 4 having the protrusive portion 8 is made of rigid resin. As shown in FIG. 2, the protrusive portion 8 projected from the case section 4 has the spaces 18. The case section 4 thus molded is set at a predetermined position in a die in which the band section 6 is molded. After being thus arranged, the die is filled with the soft resin to mold the case section 4 integral to the case section 4, thereby forming the structure 2 comprising the case and band sections 4 and 6. The contacted faces between the case and band sections 4 and 6 are sufficiently large, as shown in FIG. 3, and the spaces 18 are filled with the soft resin.

The above-described structure 2 enables the case and band sections 4 and 6 to be molded integral to each other. In addition, the case and band sections 4 and 6 can be molded integral to each other and provide excellent structural strength without using any auxiliary member. Further, other parts can be pressed into the case section 4.

Although the parts have been described as the module 14, the present invention enables the parts to be attached directly to the structure 2.

A digital wrist watch to which a second example of the case structure according to the present invention is applied and in which the parts are attached directly to the case structure will be described referring to FIGS. 4 through 8.

Figure 4:
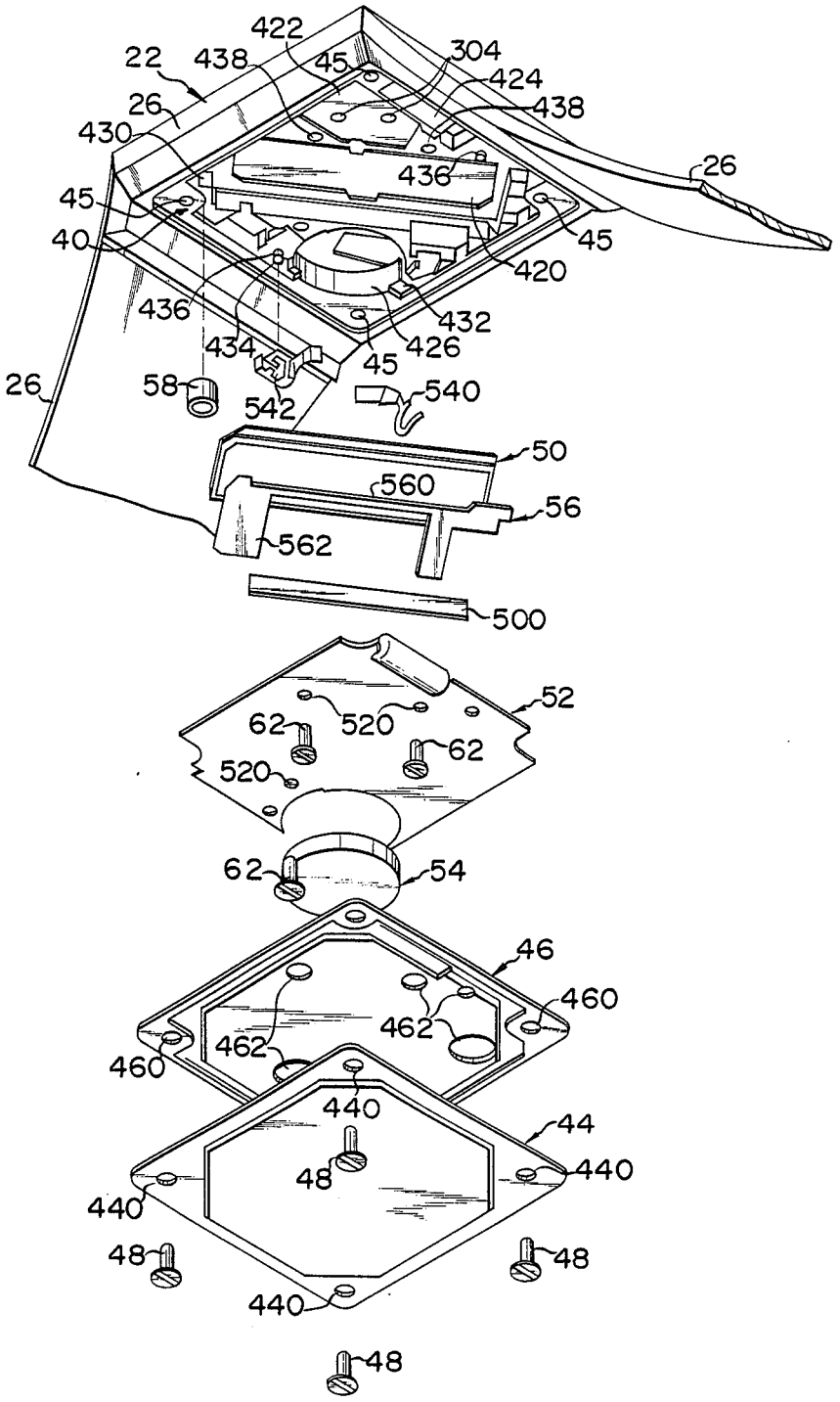
FIG. 4 is a perspective view showing a digital wrist watch dismantled and to which a second example of the case structure according to the present invention is applied.
Figure 5:
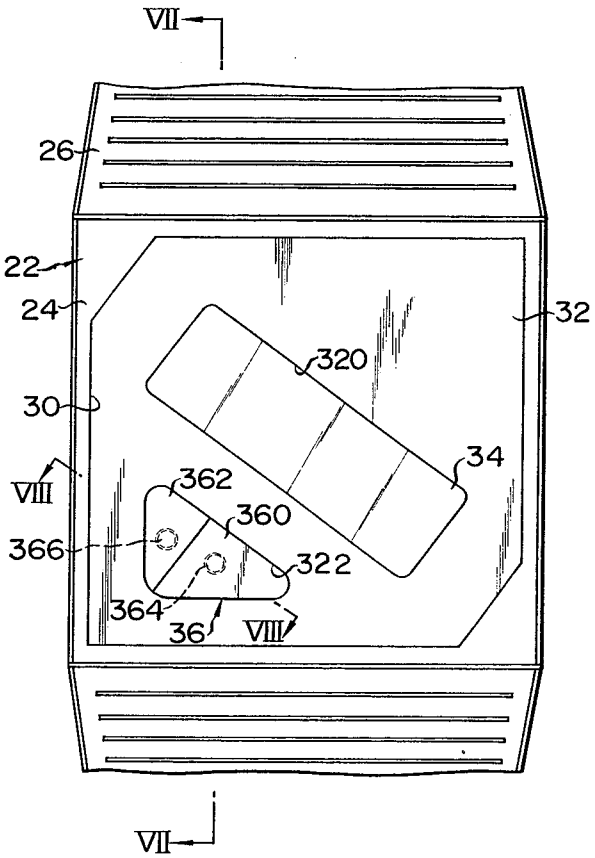
FIG. 5 is a plan view showing the digital wrist watch in FIG. 4.
Figure 7:
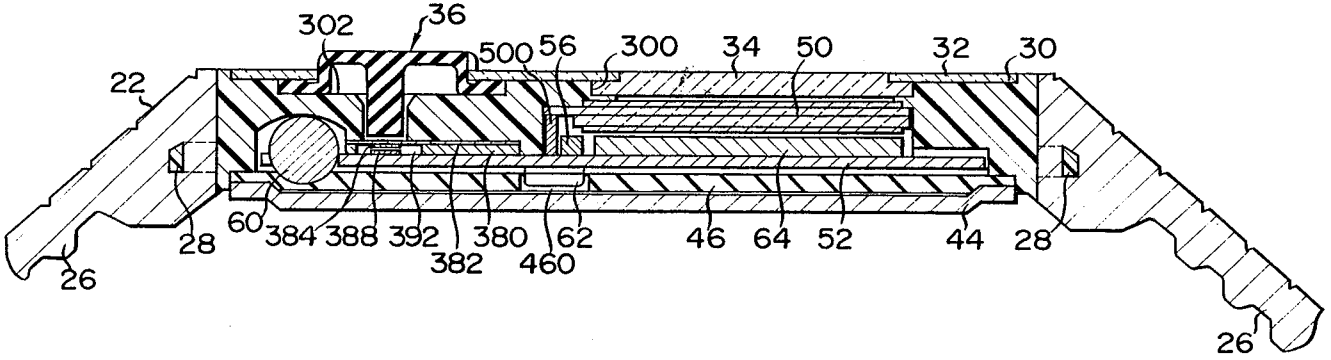
FIG. 7 is a sectional view taken along a line VII—VII in FIG. 5 and showing the main portion of the digital wrist watch.
Figure 8:
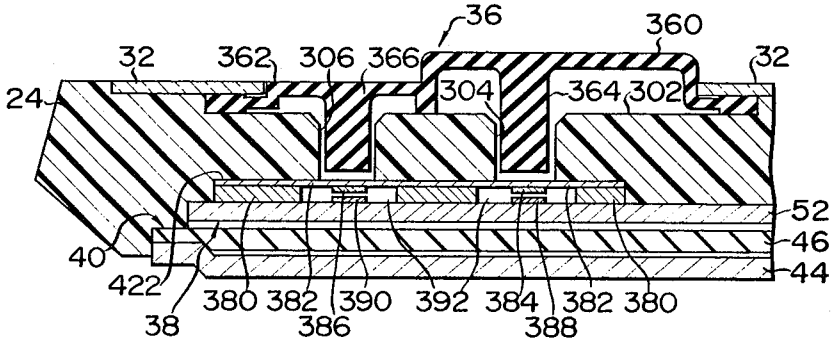
FIG. 8 is a sectional view taken along a line VIII—VIII in FIG. 5 and showing button type switches and a switch section of the digital wrist watch.

FIG. 4 is a perspective view showing the digital wrist watch dismantled. FIG. 5 is a plan view showing the digital wrist watch in FIG. 4. The digital wrist watch has a structure 22 similar to the structure 2 in FIG. 1. As described above, the structure 22 has a case section 24 molded integral to a band section 26. As shown in FIG. 7, the case section 26 is provided with protrusive portions 28. As shown in FIGS. 5 and 7, a panel-attaching portion 30 is formed as a recess on the top of the case section 24. An appearance panel 32 made of an electric conductive metal is attached to the panel-attaching portion 30. The appearance panel 32 is like a plate, and a transparent glass panel 34 and button type switches 36 which will be described later are held between the appearance panel 32 and the case section 24. A substantially rectangular opening 320 is formed at the center of the appearance panel 32, and the glass panel 34 is fitted into the opening 320. As shown in FIG. 5, the opening 320 extends along a diagonal line of the case section 24. Another opening 322 is formed in the appearance panel 32 between a long side of the opening 320 and a corner thereof. The button type switches 36 are fitted into the opening 322. As shown in FIG. 7, the panel-attaching portion 30 is made continuous to a glass panel attaching portion 300 and a switch attaching portion 302 which are further recessed downward from the panel attaching portion 30. The glass panel 34 and switches 36 are fitted into the glass panel and switch attaching portions 300 and 302. As shown in FIG. 8, two through-holes 304 and 306 are formed in the switch attaching portion 302.

The button type switches 36 are intended to change the display and correct the time, and they have projections 360 and 362. Shaft portions 364 and 366 are formed in the projections 360 and 362, respectively. The circumferential edge portion of the button type switches 36 is attached to the switch attaching portion 302 and pressed by the appearance panel 32. The projections 360 and 362 are located in the opening 322 in the appearance panel 32 and their shaft portions 364 and 366 are inserted into the through-holes 304 and 306 in the panel attaching portion 30, respectively. When the projections 360 and 362 are pushed down from outside, their shaft portions are also pushed down to project from the lower ends of the through-holes 304 and 306 in the panel attaching portion 30, respectively, thereby rendering operative a switch means which will be described later. In the case of the button type switches 36 located in the opening 322 at the appearance panel 32, the projection 360 corresponds to a display switch which is relatively often used, and it is projected from the surface of the appearance panel 32. On the other hand, the other projection 362 corresponds to a time correcting switch which is desired free from careless operation, and it is not projected from the surface of the appearance panel 32 but held same in level as the surface of the appearance panel 32, thereby protecting it from being carelessly operated.

Those parts which are to be attached to the bottom side of the structure 22 will be described, referring to FIGS. 4 and 8.

A back lid attaching portion 40 is slightly recessed on the bottom side of the case section 24 at the circumferential edge area thereof and a parts housing portion 42 is more deeply recessed inward from the back lid attaching portion 40. A back lid 44 made of an electric conductive metal is provided with screw bores 45 at its four corners. The back lid 44 is attached to the back lid attaching portion 40 through a packing 46 by screwing screws 48 into the screw bores 45. The packing 46 is like a sheet made of rubber, synthetic resin and the like, and it is provided with four bores 460 at its four corners. These four bores 460 correspond to the screw bores 440 in the back lid 44. As shown in FIG. 4, the packing 46 has a plurality of bores 462 formed at predetermined positions thereof.

Figure 6:
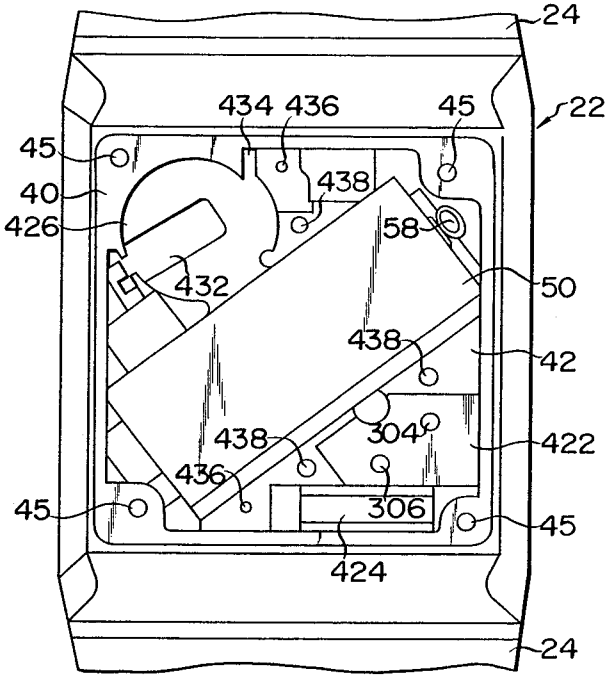
FIG. 6 is a rear elevation viewed from the bottom side of the digital wrist watch in FIG. 4, to which a crystal display panel is attached.

As shown in FIG. 7, electronic parts such as a cystal display panel 50, circuit chip 52 and battery 54 are housed in the parts housing portion 42. In addition, various kinds of parts such as an interconnector for the liquid crystal display panel 50, spacer 56, elastic member 58 and electrodes 540 and 542 of the battery 54 are attached to the parts housing portion 42. As shown in FIGS. 4 and 6, various kinds of housing portions such as a display panel housing portion 420, switch housing portion 422, crystal oscillator housing portion 424 and battery housing portion 426 are integrally formed at the parts housing section 42 together with an elastic member attaching portion 430, electrode attaching portions 432, 434, position determining projection 436, and screw bores 480. The display panel housing portion 420 is formed at the circumferential edge area of the glass panel attaching portion 300 and it houses the liquid crystal display panel 50, interconnector 500 and a spacer 56. The switch housing portion 422 is formed under the panel attaching portion 30 and it houses the switches 38. The crystal oscillator housing portion 424 is formed adjacent to the switch housing portion 422 and it houses a crystal oscillator 60. The battery housing portion 426 is formed at that corner of the case section 24 which is opposite to the switch housing portion 422, and it houses the battery 54.

The elastic member attaching portion 430 is formed at one side of the display panel housing portion 420, and an elastic member 58 is attached to the portion 430. The electrode plate attaching portions 432 and 434 are formed at two circumferential areas of the battery housing portion 426, and electrode plates 540, 542 are attached to these portions 432, 434, respectively. The position determining projections 436 are formed at predetermined positions in the parts housing portion 42, and the circuit chip 52 is position-determined by these position determining projections 436. The circuit chip 52 is attached to the case section 24 by screwing plural screws 62 into their screw bores 438.

As shown in FIG. 4, the liquid crystal display panel 50 serves to display such information as time. As shown in FIG. 7, the liquid crystal display panel 50 is housed in the display panel housing portion 402 and it has a shape which corresponds to that of the glass panel 32. It is electrically connected to the circuit chip 52 via the interconnector 500. In this case, it is held in the display panel housing portion 420 by the elastic member 58 and spacer 56. As shown in FIGS. 4 and 5, the elastic member is like a column made of elastic material such as rubber and synthetic resin, and it is attached to the elastic member attaching portion 430 so as to elastically hold the liquid crystal display panel 50 at the sides thereof.

The spacer 56 is located between the liquid crystal display panel 50 and the circuit chip 52 to support the liquid crystal display panel 50. The spacer 56 is made of synthetic resin such as polyester and vinyl chloride. A recess 560 for positioning the interconnector 500 is formed at one side of the spacer 56. Another recess 562 for housing an LSI 23 on the circuit chip 52 is also provided at the center of the spacer 56. The spacer 56 is not limited to plastic material but it may be a plastic sheet or thin metal plate which is coated with sponge.

The circuit chip 52 is housed in the parts housing portion 42, position-determined by the position determining projections 436 in the parts housing portion 42, and attached to the parts housing portion 42 by means of the screws 62. As shown in FIG. 4, the crystal oscillator 60 and an LSI 64 are attached to the top of the circuit chip 52.

As shown in FIG. 8, the switch section 38 includes a contact sheet 382 attached onto the circuit chip 52 through a spacer 380. Movable contacts 384, 386 are attached to the underside of the contact sheet 382 to correspond to the shaft portions 364, 366. Fixed contacts 388, 390 are attached onto the circuit chip 52 to correspond to the movable contacts 384, 386. When these movable contacts 384, 386 are pushed by the shaft portions 364, 366 of the button type switches 36, they are contacted with the fixed contacts 388, 390 on the circuit chip 52.

Conductivity between the appearance panel 32 and the back lid 44 will be described with reference to FIG. 9.

Figure 9:
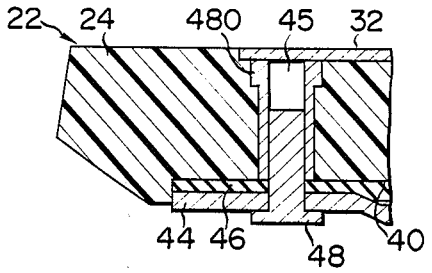
FIG. 9 is a sectional view showing a back lid attached to the case structure of the digital wrist watch in FIG. 4 by means of screws.

As shown in FIG. 9, an electric conductive set screw member 480 is inserted into the bore 45 at a corner of the case section 24. The upper end face of the set screw member 480 is contacted with the underside of the appearance panel 32. The set screw member 480 is engaged with the electric conductive screw 48 to fix the back lid 46 to the case section 24 through the packing 46. When static electricity occurs on the surface of the appearance panel 32, it is transmitted to the back lid 46 through the conductive appearance panel 32, set screw members 480 and screws 48.

It is not required that the appearance panel 32 is made of an electric conductive metal, when an electric conductive layer is formed, for example, by a plating in the inner surface of the parts housing portion 42 which is formed in the case section 24 of the structure 22 and the electric conductive back lid 44 is electrically connected to the electric conductive layer. In this modification, a film like sheet as the appearance panel 32 may be fixed on the upper surface of the case section 24, the glass panel 34 and the button type switches 36 with an adhesive agent.

A manner of attaching these parts directly to the digital wrist watch will be described below.

The glass panel 34 is attached to the glass panel attaching portion 300 on the upper side of the structure 22, and the button type switches 38 are attached to the switch attaching portion. As shown in FIG. 8, the shaft portions 364, 366 of the button type switches 36 are inserted into the through-holes 304, 306 in the switch attaching portion 302. The appearance panel 32 is attached from above the structure 22 to the panel attaching portion 300, using an adhesive. When the appearance panel 32 is attached like this, the glass panel 34 and button type switch section 36 are located in the openings 320, 322 of the appearacne panel 32 and pressed at their circumferential edge areas onto the structure 22 by means of the appearance panel 32. As described above with reference to FIG. 8, the display changing projection 360 is projected from the surface of the appearance panel 32, while the time correcting projection 362 is kept inside the opening 322 without its being projected from the surface of the appearance panel 32.

Various kinds of parts are then attached to the parts housing portion 42 on the underside of the structure 22. The elastic member 58 is attached to the elastic member attaching portion 430 and the liquid crystal display panel 50 is located in the display panel housing portion 420. One side of the liquid crystal display panel 50 is elastically pressed by the elastic member 58 in this case to hold the panel 50 in the display panel housing portion 420. The spacer 56 and inter-connector 500 are located under the liquid crystal display panel 50. The interconnector 500 is position-determined by the position determining recess 560 of the spacer 56 in this case. The contact sheet 382 is attached to the switch housing portion 422, using an adhesive. The electrode plates 540, 542 are attached to the electrode plate attaching portions 432, 434, respectively, and the circuit chip 52 is then located in the parts housing portion 42. The crystal oscillator 60 and LSI 23 are previously attached to the circuit chip 52. When the circuit chip 52 is located in the parts housing portion 42, therefore, the crystal oscillator 60 and LSI 23 are adapted to correspond to the crystal oscillator housing portion 424 and housing recess 562, respectively. The circuit chip 52 which has been located in the parts housing portion 42 like this is position-determined by the position determining projections 436. The screws 62 are then screwed into the screw bores 438 to fix the circuit chip 52 in the parts housing portion 42.

Thereafter, the battery 54 is housed in the battery housing portion 426. The back lid 44 is then located in the back lid attaching portion 40 through the packing 44 and then attached to the structure 22 by means of the screws 48. Heads of the screws 62 for fixing the circuit chip 52 are located in the bores 462 of the packing 46, respectively.

In the case of the digital wrist watch shown in FIGS. 4 through 8, various kinds of electronic parts such as the liquid crystal display panel 50, circuit chip 52 and battery 54 are attached directly to the structure 22 which is formed, as a unit, by the case and band sections 24 and 26. As the result, the digital wrist watch can be assembled more efficiently and made slimmer and smaller in size as a whole.

The thickness of the digital wrist watch which has been assembled as described above will be described.

The thickness of the glass panel 32 is 0.8 mm, the interval between the glass panel 32 and the liquid crystal display panel 50 0.1 mm, the thickness of the liquid crystal display panel 50 0.95 mm, the thickness of the LSI 64 0.5 mm, the thickness of the circuit chip 52 0.4 mm, the head thickness of the screw 62 for fixing the circuit chip 52 0.45 mm, the interval between the head of the screw 62 and the back lid 44 0.2 mm, and the thickness of the back lid 44 0.5 mm. Therefore, the thickness ranging from the surface of the liquid crystal display panel 50 to the underside of the circuit chip 52 is 1.55 mm. The thickness of the whole digital wrist watch is about 4 mm.

In the case of the embodiment shown in FIGS. 4 through 8, the circuit chip 52 is attached to the structure 22 by means of the screws 62 and the battery 54 has a thickness larger than that of the circuit chip 52, projecting from the circuit chip 52. In a case where the circuit chip 52 is attached to the structure 22 by adhesive and a slimmer battery 54 which is not projected from the circuit chip 52 is used, however, the digital wrist watch can be made slimmer by such a value that corresponds to the head thickness (0.45 mm) of the screw 62. In a case where a film-like liquid crystal display means is used as the liquid crystal display panel 50 and a film-like substrate is used as the circuit chip 52, their thickness become 0.5 mm and 0.1 mm, respectively, thereby enabling the digital wrist watch to have a thickness of about 3 mm.

Variations of the above-described case structure 2 or 22 which have protrusive portions different from those 8 or 28 of the case structure 2 or 22 will be described referring to FIGS. 10 through 14. A case structure 102 shown in FIG. 11 is same as the one 2 shown in FIG. 1 except the shape of its protrusive portion 108.

Figure 10:
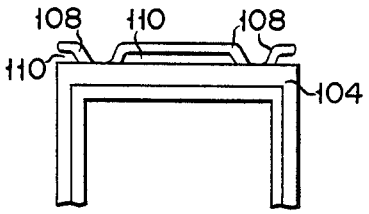
FIG. 10 is an enlarged view showing projections projected from the case section of a digital wrist watch to which a third example of the case structure according to the present invention is applied.
Figure 11:
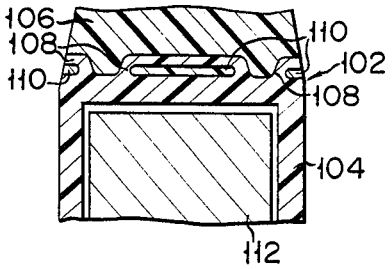
FIG. 11 is a schematic sectional view similar to FIG. 3 and showing the digital wrist watch in FIG. 10.

As shown in FIG. 10, the protrusive portion 108 along the end of a case section 104 is longer than the portions 8 in FIG. 1.

Figure 13:
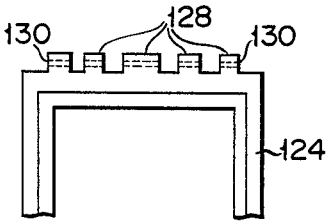
FIG. 13 is an enlarged view showing projections projected from the case section of the digital wrist watch in FIG. 12.
Figure 14:
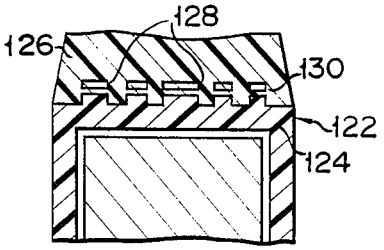
FIG. 14 is a schematic sectional view similar to FIGS. 3 and 11 and showing the digital wrist watch in FIG. 12.

As shown in FIG. 13, a plurality of projections 128 are provided at the edge of a case section 124. Each of the projections 128 has a through hole 130, said holes 130 extending along the edge of the case section 124.

Figure 12:
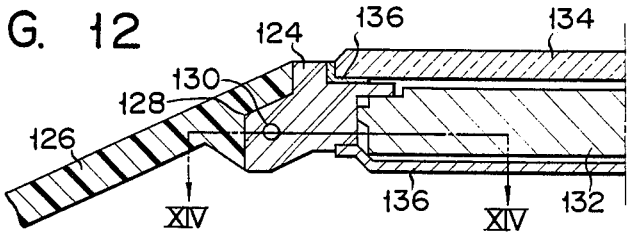
FIG. 12 is an enlarged sectional view showing the main portion of a digital wrist watch to which a fourth example of the case structure according to the present invention is applied.

Each of these structures 102 and 122 is molded as a unit similar to those 2 and 22. In other words, the case section 104 or 124 is molded in its die and then set at the predetermined position in band section die, which is filled with soft resin to form the case section 104 or 124 integral to the band section 106 or 126, as shown in FIGS. 11 through 13.

In the case of these structures 102 and 122, the case section 104 or 124 is strongly combined with the band section 106 or 126 by means of the projections 108 or 128 and spaces 110 or holes 130, particularly because the spaces 110 or holes 130 are filled with soft resin when the band section 106 or 126 is molded. These structures 102 and 124 are strong in their connection between the case and band sections and also excellent in their durability.

Although all of the case sections 4, 24, 104 and 124 have been made rectangular in the above-described examples of the case structures 2, 22, 102 and 122, they are not limited to this rectangular shape but may be made in circular, oval and any other shapes.

In the embodiment described above, the portrusive portion 8 or 28 is formed on the case section 4 or 24. However, a recess may be formed in the case section 4 or 24 instead of the protrusive portion 8 or 28 and the recess may be filled with a soft resin to form an integral structure of the case section 4 or 24 and band section 6 or 26 in a molding process.

Although description has been made relating to the case where the present invention is applied to the digital wrist watch of the digital display type, the present invention may be applied to the digital wrist watch of the analog display type. The case section which is made integral to the band section is used as a base in this case and the rotor, stator, coil and the like which form a step motor are attached directly to this base. The present invention may be applied to the mechanical wrist watch.

What is claimed is:

1. A watch apparatus comprising:

watch parts for displaying the time for a watch user including a crystal oscillator for generating periodic vibrations, a display panel for displaying information for the watch user, an integrated circuit chip for controlling the display panel resposnive to the periodic vibrations applied from the crystal oscillator, and a battery for providing a power source for said chip;

a case formed of a rigid plastic material and having an opening in its face, said case having a plurality of recesses fromed therein for receiving said display panel, battery, and crystal oscillator separately form one another, said plurality of recesses being divided from one another by at least one partition wall, wherein longer sides of the recess for storing said display panel are formed oblique to the direction in which said band is extend, the recess for storing said battery being formed between one longer side of said display panel-storing recess of said case and one corner of said case which faces said one longer side of the display panel-storing recess, and the recess for storing said crystal oscillator is formed between the other longer side and another corner of said case which faces said other longer side;

a transparent glass panel which is secured to said case and fitted in said opening;

a band formed integral to said case and adapted to attach said case to an arm of a watch user, said band being made of a flexible plastic material which is softer than the rigid plastic material of said case.

2. A watch apparatus according to claim 1, wherein said case has a protrusive portion embedded in the band, and said band is formed integral to the case, enclosing the protrusive portion of said case.

3. A watch apparatus according to claim 2, wherein the protrusive portion has a hole formed therein.

4. A watch apparatus according to claim 1, wherein said case has recesses into which said band is embedded.

5. A watch appratus according to claim 1, wherein said case is made of ABS (acrylonitrile-butadiene-styrene) resin, while said band is made of polyurethane resin.

6. A watch apparatus according to claim 1, wherein said case has an opening into which the watch parts are attached, and a back lid, which is contacted with the arm of the watch user, is attached to the case to cover the opening.

7. A watch apparatus according to claim 6, further comprising a packing fixed between said case and the back lid.

8. A watch apparatus according to claim 1, wherein said chip is arranged below said display panel within said case.

9. A watch apparatus according to claim 1, wherein said watch parts further include a circuit board for electrically connecting said crystal oscillator, said display panel, said chip, and said battery, and said circuit board is attached directly to said base by a screw.

10. A watch apparatus according to claim 1, further comprising an elastic member means for fixing the display panel in the recess of said case with an elastic urging force.

11. A watch apparatus according to claim 1, wherein said watch parts include a button type switch arranged on a face of said base, said face being opposite to and spaced from another face thereof which is in contact with an arm of the watch user.

12. A watch apparatus according to claim 11, wherein the button type switch has plural switch button portions made of synthetic resin and made integral to one another, and at least one of these button portions is kept lower than the other projected ones.

13. A watch apparatus according to claim 1, further comprising a film-like appearance panel which adheres to said case and said glass panel so that the glass panel is fixed in the opening of said case.

14. A watch apparatus accoring to claim 13, wherein said watch parts include a button type switch arranged on a fae of said case, said face being located opposite to and spaced from another face thereof which is in contact with an arm of the watch user, and the button type switch is fixed in the case by the film-like appearance panel.

15. A watch apparatus according to claim 1, further comprising an electrically conductive back lid to be contacted with an arm of the watch user, said lid being fixed to the case to close the recess by an electric conductive member, an appearance panel attached to a face of said cse located opposite to the back lid, and the back lid and the appearance panel being electrically connected by said electrically conductive member.

* * * * *

UNITED STATES PATENT AND TRADEMARK OFFICE

CERTIFICATE OF CORRECTION

PATENT NO. : 4,727,524

DATED : Feb. 23, 1988

INVENTOR(S) : SHOJI et al

It is certified that error appears in the above-identified patent and that said Letters Patent is hereby corrected as shown below:

Title page, left-hand column, the Filing Date should read -- July 27, 1987 -- not "February 27, 1987"

After "Related U.S. Application Data" section insert -- Foreign Application Priority Data

| | | |
|---|---|---|
| March 26, 1984 | JAPAN | 43954(U) |
| November 30, 1984 | JAPAN | 182062(U) -- |

After "Related U.S. Application Data, Continuation of Ser. No. 714,189, Mar. 20, 1985" insert --, abandoned --.

Signed and Sealed this

Second Day of August, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,727,524

DATED : Feb. 23, 1988

INVENTOR(S) : SHOJI et al

It is certified that error appears in the above-identified patent and that said Letters Patent is hereby corrected as shown below:

Title page, left-hand column, the Filing Date should read -- July 27, 1987 -- not "February 27, 1987"

After "Related U.S. Application Data" section insert -- Foreign Application Priority Data

| | | |
|---|---|---|
| March 26, 1984 | JAPAN | 59-43954(U) |
| November 30, 1984 | JAPAN | 59-182062(U) -- |

After "Related U.S. Application Data, Continuation of Ser. No. 714,189, Mar. 20, 1985" insert --, abandoned --.

This certificate supersedes Certificate of Correction issued August 2, 1988.

Signed and Sealed this

Seventeenth Day of January, 1989

*Attest:*

*Attesting Officer*

DONALD J. QUIGG

*Commissioner of Patents and Trademarks*